US006230631B1

(12) United States Patent
Archilla Aldeanueva et al.

(10) Patent No.: US 6,230,631 B1
(45) Date of Patent: May 15, 2001

(54) ROLLING MONOAXLE PROVIDED WITH MOVABLE INDEPENDENT WHEELS FOR ARTICULATED RAILWAY CARRIAGES INTENDED TO THE TRANSPORTATION OF CARS

(75) Inventors: Luis Archilla Aldeanueva; Julio Frutos Aguado, both of Madrid (ES)

(73) Assignee: Patents Talgo S.A., Madrid (ES)

( * ) Notice: Subject to any disclaimer, the term of this patent is extended or adjusted under 35 U.S.C. 154(b) by 0 days.

(21) Appl. No.: 09/125,213

(22) PCT Filed: Nov. 28, 1997

(86) PCT No.: PCT/ES97/00295

§ 371 Date: Nov. 20, 1998

§ 102(e) Date: Nov. 20, 1998

(87) PCT Pub. No.: WO98/28176

PCT Pub. Date: Jul. 2, 1998

(30) Foreign Application Priority Data

Dec. 24, 1996 (ES) ..... 9602736

(51) Int. Cl.[7] ..... B61F 5/26

(52) U.S. Cl. ..... 105/218.1; 105/3; 105/4.4; 105/96.1; 105/175.1; 105/199.5; 104/32.1

(58) Field of Search ..... 105/3, 4.1, 4.4, 105/165, 178, 167, 168, 182.1, 218.1, 224.05, 199 R, 199.5, 197.05, 224.1, 96.1; 104/32.1, 32.3

(56) References Cited

U.S. PATENT DOCUMENTS

| | | | | |
|---|---|---|---|---|
| 4,480,554 | * | 11/1984 | Brodeur et al. | 105/171 |
| 4,637,318 | * | 1/1987 | Paton | 105/167 |
| 5,001,989 | * | 3/1991 | Mulcahy et al. | 105/199.5 |
| 5,524,552 | * | 6/1996 | Weber | 105/199.5 |

* cited by examiner

*Primary Examiner*—S. Joseph Morano
*Assistant Examiner*—Frantz Jules
(74) *Attorney, Agent, or Firm*—Ladas & Parry

(57) ABSTRACT

Single-axle running gear with movable independent wheels for articulated car transporter wagons. The running gear comprises a carrying frame (1), suspension springs (2) with vertical dampers (AV) mounted inside them, sliding shoes for supporting the running gear during the process of changing track gauge, suspension headers (4) with stabilizing arms (5), hanging suspension links connected to the suspension headers, and systems for guiding the running gear. The invention is useful for allowing the articulated car transporter platform wagons to be used on networks with two different track guages.

18 Claims, 6 Drawing Sheets

ROLLING MONOAXLE PROVIDED WITH MOVABLE INDEPENDENT WHEELS FOR ARTICULATED RAILWAY CARRIAGES INTENDED TO THE TRANSPORTATION OF CARS

FIELD OF THE INVENTION

The present invention relates to a single-axle running gear with movable independent wheels for articulated wagons intended for transporting cars and able to run at speeds of 200 km/h. Incorporating running gears of this type on such wagons will make it possible for them to be used for two different track guages.

BACKGROUND OF THE INVENTION

As is known, transporting cars by rail is done with articulated platform wagons which, normally, are designed to run on a single track gauge. Nevertheless, it would be desirable for these wagons to be able to be fitted with single-axle running gears with movable independent wheels and thus to be made able to run on railway networks with two different track gauges.

The problem of constructing running gears with movable independent wheels has already been solved by the applicant, who is the holder of patent FR-A-1, 558, 329, in which are described single-axle bogies with a variable distance between the wheels. In this patent, each set of running gear of the bogie consists of a half-axle, a wheel, two brake discs integral with each other and two axle boxes mounted at both ends of the half-axle, the said axle boxes being fixed in the position corresponding to each track gauge by means of respective locking keys.

SUMMARY OF THE INVENTION

Starting with the bogie described in the abovementioned French patent, and taking account of the particular characteristics of the articulated platform wagons intended for transporting cars, the applicant has developed a single-axle running gear with movable independent wheels which can be fitted to such wagons, incorporated in two trailers which are connected together, so that they can run not just on a single track gauge, but on two different track guages. Moreover, given the characteristics offered by these wagons after they have been equipped with the running gears in accordance with the invention, such as those of making use of independent wheels, not having to withstand heavy loads and being equipped with guidance systems, the said wagons are then able to run at speeds of 200 km/h.

Consequently, the invention provides a single-axle running gear with movable independent wheels for articulated car transporter wagons, this running gear being capable of running on two different track gauges, and including two sets of running gear, each of which comprises a half-axle, a wheel, two brake discs integral with each other and two axle boxes which are mounted at both ends of the half-axle and which are fixed to it in the position corresponding to each track gauge by means of respective locking keys, the said running gear comprising:

- a carrying frame in which are incorporated the axle boxes of each set of running gear and the mechanisms necessary for translating and locking the said sets;
- suspension springs incorporated in housings in the lateral parts of the carrying frame and provided with vertical dampers mounted inside them;
- sliding shoes incorporated in the lateral parts of the carrying frame and intended to support the running gear during the process of changing track gauge;

- suspension headers on which the upper parts of the suspension springs bear, and in which the bells of the vertical dampers are fixed;
- arms for stabilizing the suspension headers;
- hanging suspension links connected at their upper ends to the suspension headers and at their lower ends to corresponding supports integral with the frame of the wagon; and
- guidance systems for causing the angle formed by the rim of the wheel and the tangent to a curve of the track to be zero at the point of contact with the track.

According to the invention, each set of running gear carries two locking keys, one for each axle box.

Likewise, according to the invention, the brake of each set of running gear is of the calliper type and comprises a pneumatic actuating cylinder and friction linings which are applied by the said cylinder against half-discs fastened to the web of the corresponding wheel. Both the pneumatic actuating cylinder and the brake calliper with the friction linings are integral with a support which is fixed to the inner axle box of the corresponding wheel and can be moved as a unit with the set of running gear.

The systems for guiding the running gear of the invention will differ according to whether an intermediate running gear or an extreme running gear is involved. Thus, in the case of an intermediate running gear, the guidance system consists of two guidance lever arms fitted in a horizontal position in the carrying frame of the running gear and of two pairs of guide bars which are fixed at one end to the said lever arms and at their other end to the respective adjacent end faces of the two trailers constituting the wagon. In the case of an extreme running gear, the guidance system consists of a control mechanism and of a guidance mechanism proper, of which the guidance mechanism is formed by two lever arms and two pairs of bars which are connected at one end to the said lever arms, the other end of the first pair of said bars being connected to bell cranks which form part of a compensation mechanism, and the other end of the second pair of said bars being connected to a support of the wagon, while the control mechanism consists of two control bars; one of the said ends is connected to the end face of the adjacent trailer and the other end is articulated to corresponding lever arms, adjustable bars being fitted between the said lever arms and the bell cranks of the compensation mechanism, and the longitudinal arms of the said bell cranks being connected together by means of a crossbar which also forms part of the said compensation mechanism.

BRIEF DESCRIPTION OF THE DRAWINGS

The foregoing and other characteristics of the invention will emerge clearly in the light of the following detailed description, with reference to the attached drawings, in which.

DETAILED DESCRIPTION OF THE INVENTION

Figure 1:
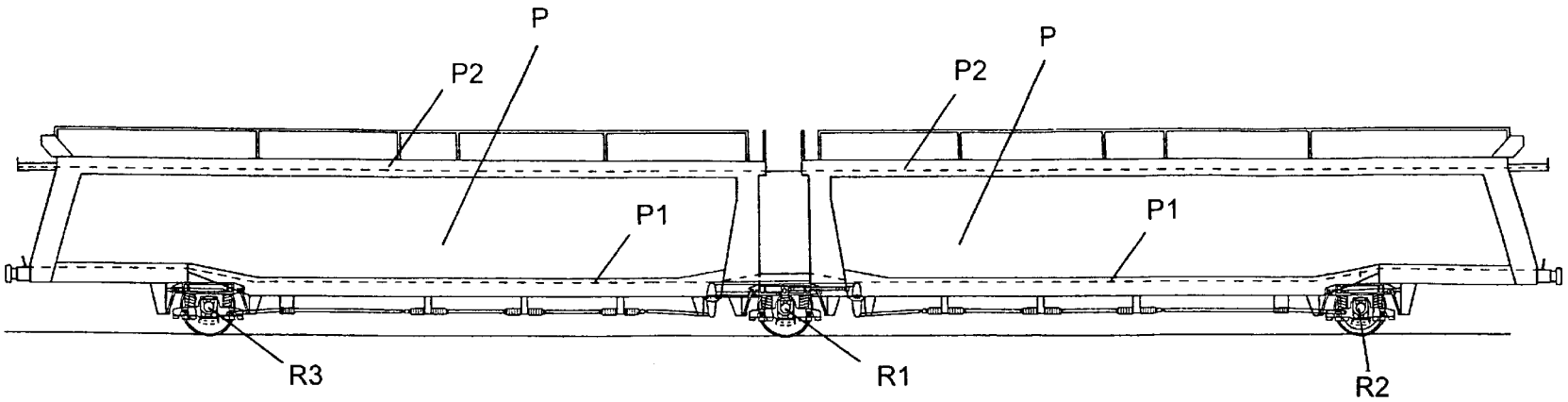
FIG. 1 is a side elevation view of a car transporter platform which incorporates running gears of the present invention.

FIG. 1 shows wagon which incorporates three running gears R1, R2, R3 in accordance with the present invention. This wagon is of articulated construction and is formed by two platforms P, each with two levels P1, P2, which allow the vehicles to be loaded and unloaded, at the two levels, through their end faces, also allowing the vehicles to pass from one platform to another and to the adjacent wagons, in the case where various wagons like the one illustrated in FIG. 1 are incorporated in a train.

The three running gears R1, R2, R3, which are apparent in FIG. 1 are basically identical, and their construction will now be described with reference to FIGS. 2 and 3, which illustrate the intermediate running gear R1.

As is depicted in the said figures, the running gear R1 (and likewise the end running gears R2, R3) includes a carrying frame 1 in which are incorporated the axle boxes CC (FIG. 3) of each set of running gear, and likewise the necessary mechanisms for the translation and locking of the said sets. The said carrying frame 1 has, in its lateral parts, housings in which are incorporated suspension springs 2. Vertical dampers AV are mounted within the suspension springs 2.

The carrying frame 1 also has, incorporated in its lateral parts, sliding shoes 3, on which the running gear R1 rests during the process of changing guages, such that the wheels W are unloaded and thus the translation from one gauge to another is greatly facilitated.

The upper parts of the suspension springs 2 bear on suspension headers 4, on which are also fixed the bells of the vertical dampers AV. The said suspension headers are stabilized by means of sets of arms 5 (FIG. 3).

Figure 2:
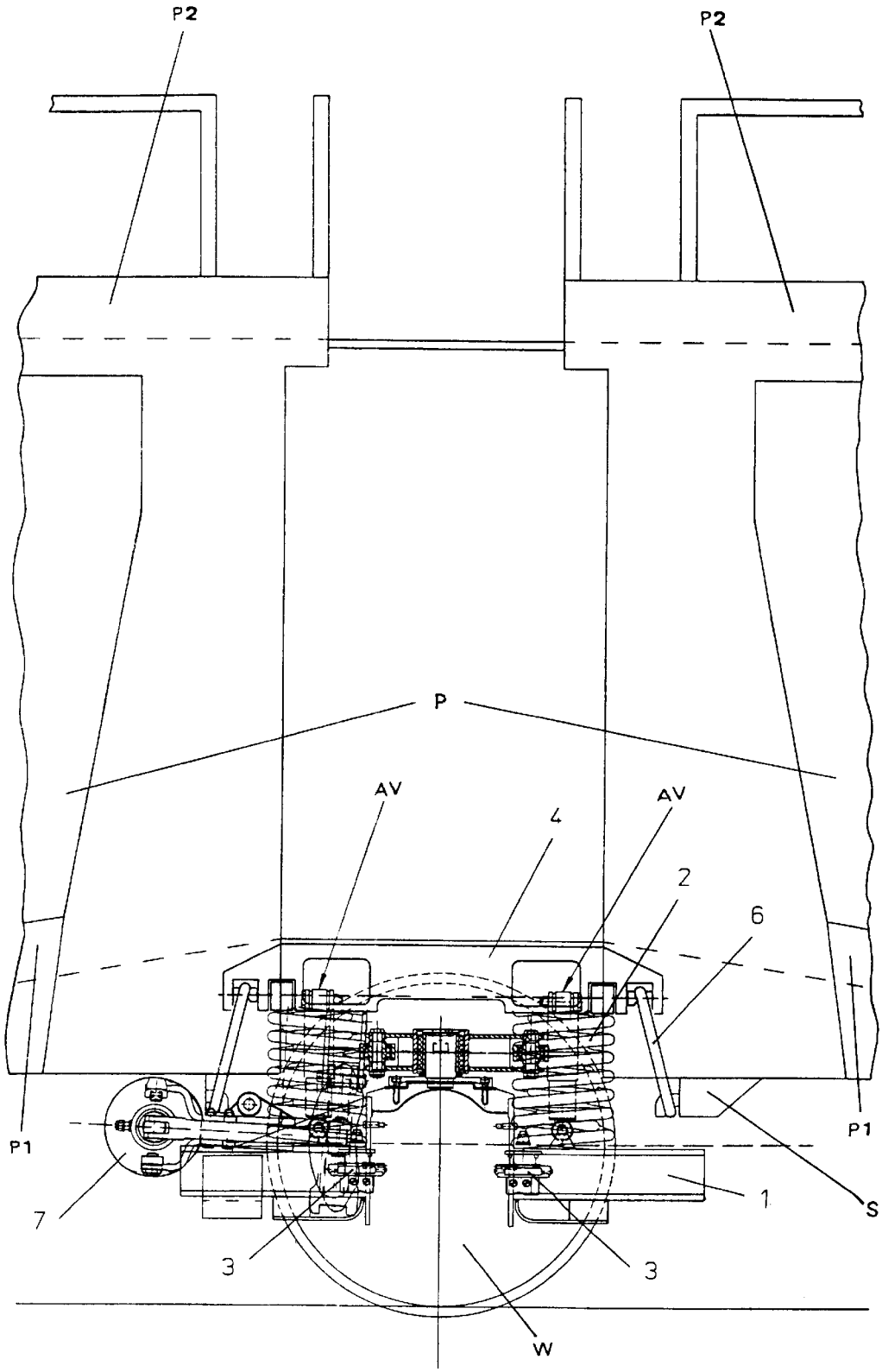
FIG. 2 is an elevation view, with sectioned parts, of the intermediate running gear of the platform of FIG. 1.

As can be seen in FIG. 2, hanging suspension links 6 are provided, the upper ends of which are connected to the suspension headers 4, while the lower ends of the said hanging suspension links 6 are fixed to supports S which are integral with the frame of the wagon. That being so, the platforms P are suspended from the lower part of the said hanging suspension links 6, the load being transmitted from them to the suspension springs 2 via the said hanging suspension links 6.

As a consequence of the inclination which they present with respect to the vertical plane which passes through the longitudinal axis of the track, the hanging suspension links 6 generate a force for self-centring of the running gear R1 and, due to the inclination which they have with respect to the vertical plane transverse to the axis of the track, they provide a force countering the transverse movements between the platforms P and the running gear R1.

Figure 3:
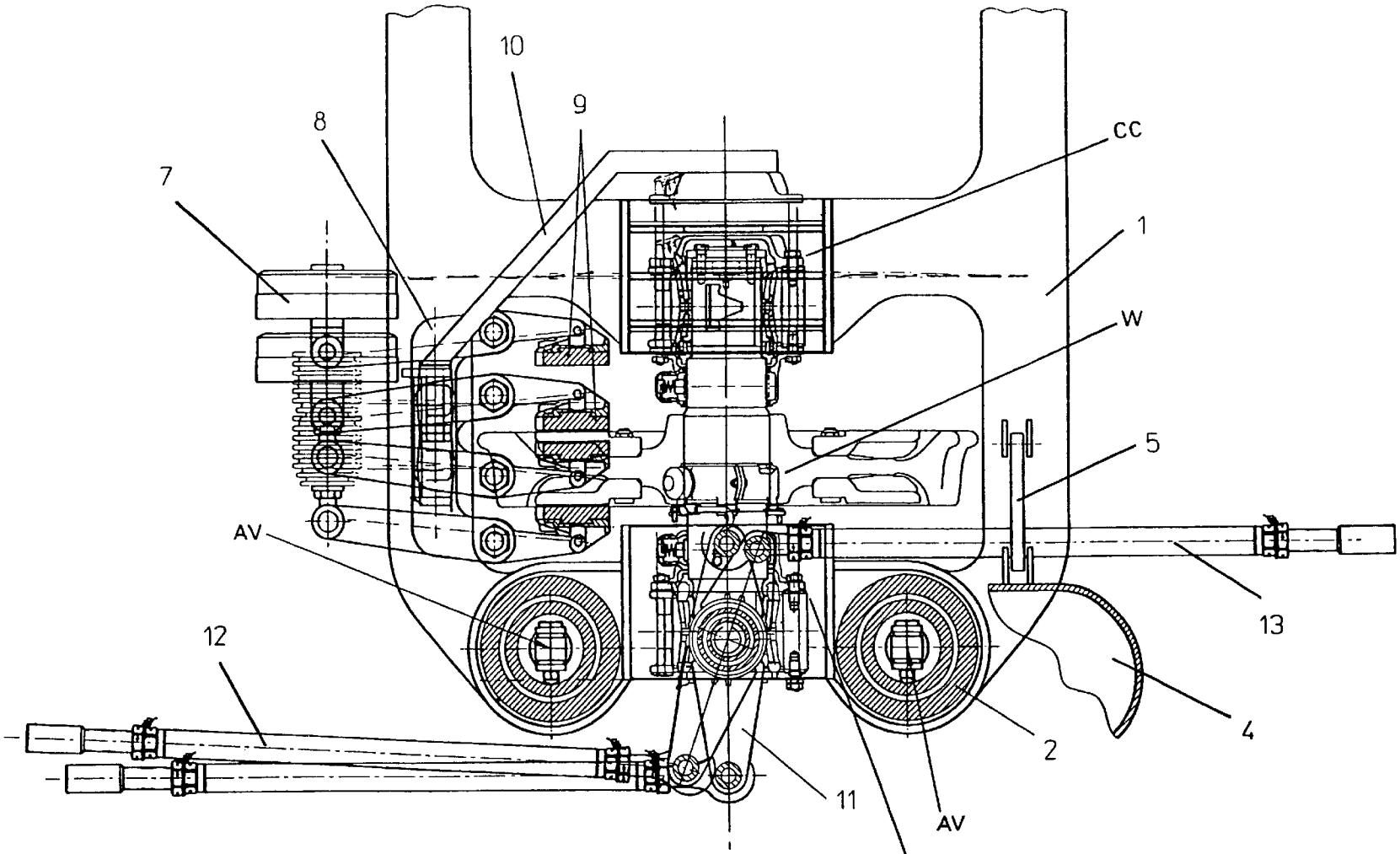
FIG. 3 is a plan view, with sectioned parts, of the running gear of FIG. 2.

FIG. 3 also illustrates the braking system used in the running gear R1 of the invention (an identical braking system will also be mounted on the running gears R2, R3). This braking system is of the "calliper" type and comprises a pneumatic actuating cylinder 7, a calliper 8 and friction linings 9 which are applied by the cylinder 7 against half-discs fastened to the web of each wheel W.

The pneumatic actuating cylinder 7, as well as the brake calliper 8 and the friction linings 9, are integral with a support 10 which is fixed to the inner axle box CC of the corresponding wheel W and can be moved as a whole with the set of running gear in order to adjust the braking system to both track guages and thus guarantee the correct operation thereof.

Figure 4:
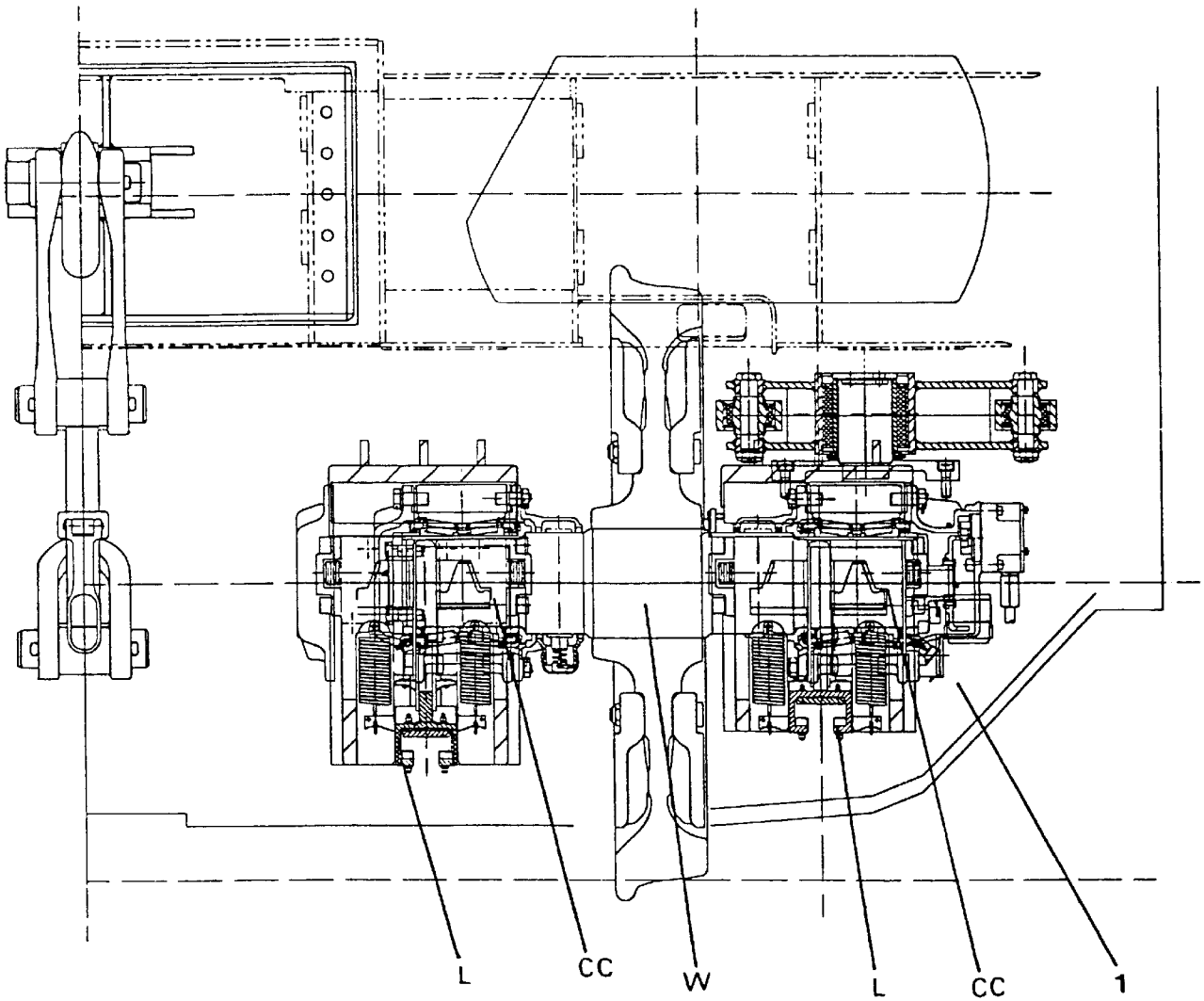
FIG. 4 is a view, with sectioned parts, intended fundamentally to show the system for locking the axle boxes of the running gear of the invention.

Referring now to FIG. 4, it can be seen that the system for locking the axle boxes CC is a dual one, that is to say that each of the said axle boxes is locked with its corresponding locking key L. The description of this locking system is omitted here, since it has already been explained in detail in the patent FR-A-1, 558, 329.

The running gears R1, R2, R3 of the present invention are provided with guidance systems with the aim of ensuring that the angle which the rim of the wheel W forms with the tangent to a curve of the railway track at the point of contact with it is zero. By virtue of these guidance systems, a substantial lowering of the risk of derailment due to the rim of the wheel riding up is obtained, and, moreover, a substantial reduction in the wear on the rim is achieved.

These guidance systems will differ according to whether intermediate running gears or extreme running gears are involved.

The guidance system of the intermediate running gear R1 can be seen in FIG. 3. This system, on each side of the wagon, consists of a guidance lever arm 11 fitted in the carrying frame 1 of the running gear R1 in the horizontal position, and of two guide bars 12, 13, of which the bar 13 is connected at one end to the adjacent end face of one of the trailers constituting the wagon and the other bar 12 is connected at one end to the adjacent end face of the attached trailer. These connections have not been represented in FIG. 3. The other ends of the bars 12, 13 are connected to the lever arm 11.

The lever arm 11 and the bar 12 have been represented in FIG. 3 in two positions which they can adopt while the train is running: one corresponding to the train running in a straight line (lever arm 11 perpendicular to the wheel W in the drawing) and the other corresponding to the train running on a curve (lever arm 11 inclined with respect to the wheel W in the drawing).

This guidance system, when the train is on a curve, allows the end faces of the adjacent trailers to come closer to each other on the inside of the curve, pushing on the guide bars 12, 13 arranged on that side of the curve, which, in their turn, transmit the movement to the ends of the corresponding lever arm 11, causing the latter to turn about its spindle. Simultaneously, the end faces of both trailers move apart from one another on the outside of the curve, pulling the guide bars 12, 13 arranged on that side of the curve and they, in their turn, transmit a movement from the corresponding lever arm 11 turning about its spindle, of equal magnitude, but opposite in direction to the turning of the lever arm 11 situated on the inside of the curve. These movements are converted into a rotation of the bogie about its vertical axis, the latter being situated in a radial position with respect to the centre of the curve.

As has already been said, the guiding of the extreme running gears R2, R3 differs from that of the intermediate running gear R1, since in the former case no use can be made of the help from the adjacent end face of an attached trailer. Nevertheless, the basic principle employed for guiding the extreme running gears R2, R3 is the same and consists in taking advantage of the relative turning movement between the two articulated platforms P, which is transmitted by means of two mechanisms, one for control and the other for guidance, from the coupling of each of the platforms P to the positions of the running gears R2, R3 at both ends, where the guidance proper of these running gears is applied in a way similar to that of the guidance of the intermediate running gear R1.

Figure 5A:
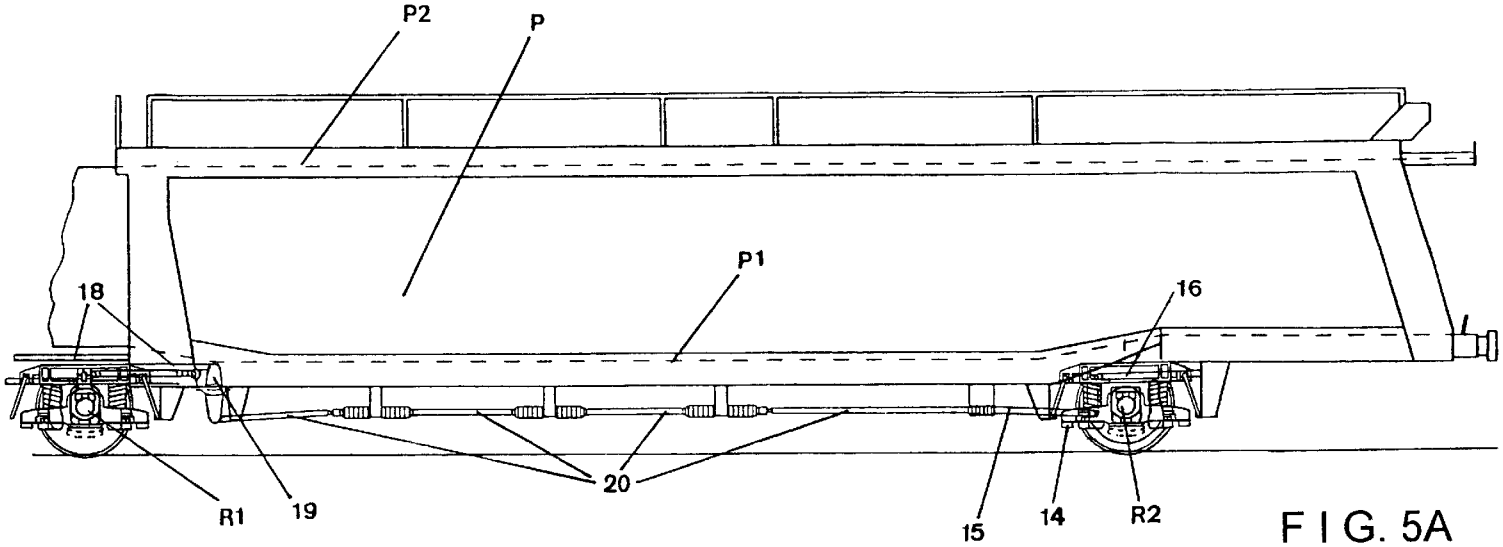
FIGS. 5A and 5B are elevation and plan views respectively, diagrammatically representing the guidance system used in running gears in accordance with the invention.
Figure 5B:
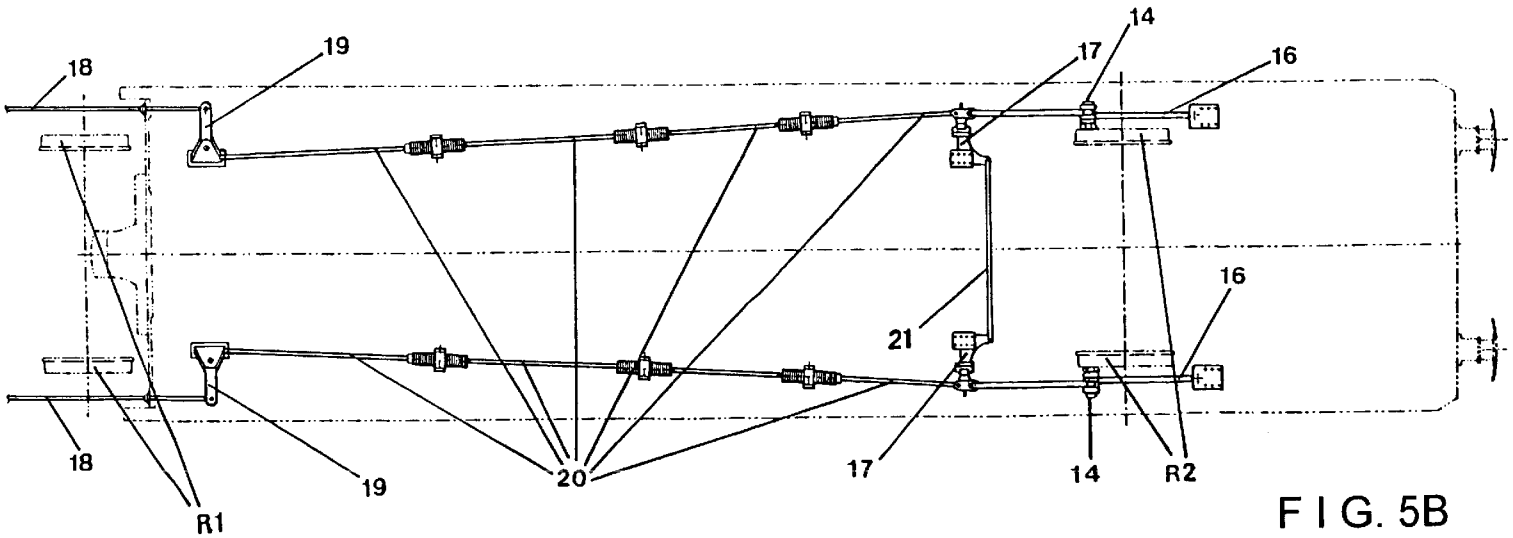

The two abovementioned mechanisms have been represented diagrammatically, in elevation and plan view, in FIGS. 5A and 5B, the control mechanism being represented in the left-hand part and the guidance mechanism proper of an extreme running gear R2 being represented in the right-hand part. The other extreme running gear R3 would use an equivalent assembly.

The guidance mechanism is formed by two lever arms 14 and two pairs of bars 15, 16. The guide bars 15 are connected at one end to their corresponding lever arm 14 and at the other end to bell cranks 17 which form part of a compensation mechanism. The guide bars 16 are also connected at one end to their corresponding lever arm 14 and at the other end to a support of the wagon.

The control mechanism, on each side of the trailer, consists of a control bar 18, one of whose ends is connected to the end face of the adjacent trailer and the other end is articulated to a lever arm 19. Between the lever arm 19 and the bell cranks 17 of the compensation mechanism, adjustable bars 20 are fitted, the longitudinal arms of the bell cranks 17 being connected together by means of a crossbar 21 which also forms part of the abovementioned compensation mechanism.

Figure 6A:
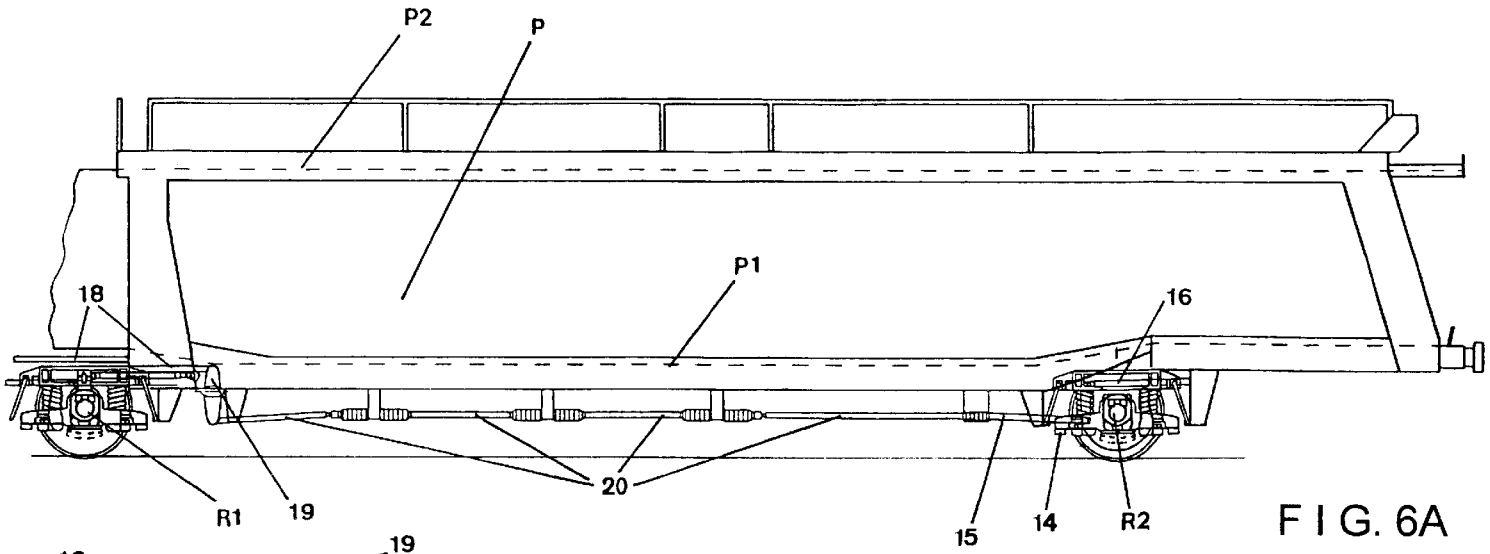
FIGS. 6A and 6B are plan and elevation views respectively, illustrating the position which the guidance system of FIGS. 5A and 5B would take up when the articulated wagon set lies on a curve.
Figure 6B:
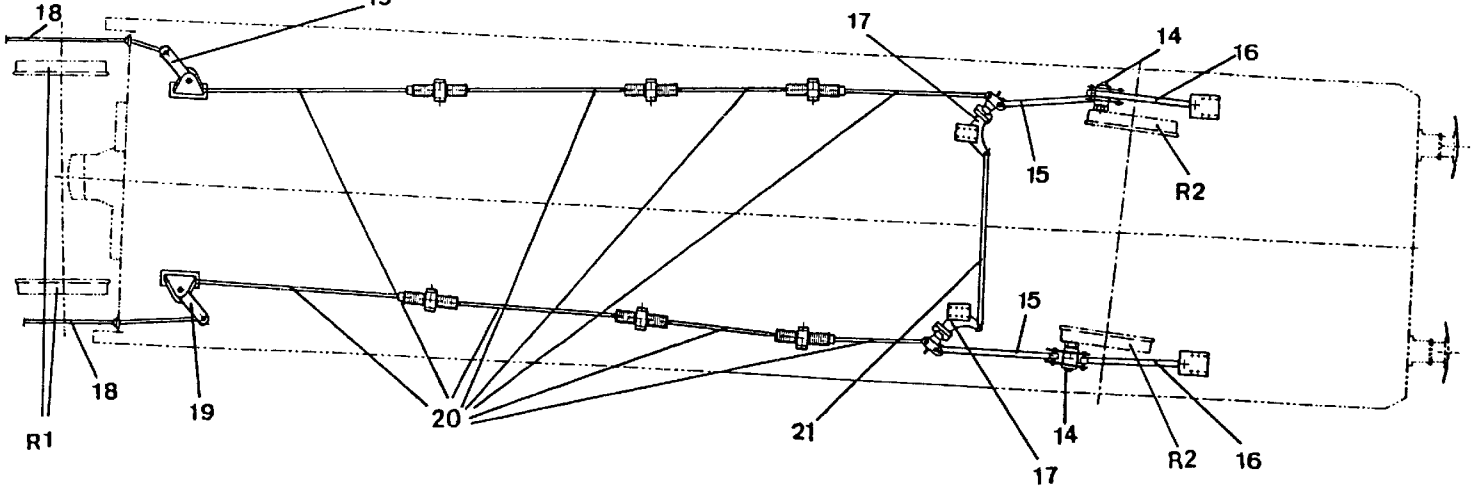

The same elements of FIGS. 5A and 5B respectively have been represented again in FIGS. 6A and 6B, also in plan and elevation view, but illustrating the position which the control and guidance mechanisms would take up when the articulated wagon set lies on a curve. On entering the curve, for example to the left, the end faces of the adjacent trailers come closer on the inside of the curve and move apart on the outside, and the bar 18 on the inside of the curve pushes on the corresponding lever arm 19, while the other bar 18 situated on the outside of the curve pulls on the other lever arm 19. Both lever arms then turn by the same angle, but in opposite directions, around their respective spindles which are fixed to the structure of the trailer, being inclined as indicated in FIG. 6B.

For their part, the adjustable bars 20, pulled on by the lever arms 19, slide longitudinally on their support guides, which are integral with the frame of the trailer. Of these bars 20, the one which is working in tension (the bar on the inside of the curve according to FIG. 6B) pulls on the corresponding bell crank 17 of the compensation mechanism and transmits the longitudinal movement to the bars 15, which shift the ends of the bogie in the opposite direction by means of the lever arms 14.

The incorporation of the running gears of the invention on articulated car transporter platform wagons represents a relatively simple solution for allowing such wagons to be able to travel on networks with two different guages, additionally improving the usefulness of this type of wagon. In particular, these wagons, once they are equipped with the running gears of the invention, will offer better dynamic characteristics, which will make it possible to increase their maximum running speed to 200 km/h on either of the two guages, since the guidance system which the running gears have will safely maintain the required stability of the wagons when running over curved sections of track.

Although the essential characteristics of the invention have been stressed in the foregoing description, it will be understood that it is capable of variations of form and of detail without thereby departing from the spirit of the invention. That being so, the scope of the invention is regarded as being limited only by the content of the attached claims.

What is claimed is:

1. Apparatus for enabling a railway wagon to run on two different gauges of track the railway wagon having two articulated trailers and a plurality of running gears rollably supporting the trailers on the track, each running gear having two sets and a carrying frame for said running gear sets fixed to said wagon, each running gear set comprising:

a half-axle, an independent wheel settable at the different track gauges, two brake discs fastened to said wheel and two axle boxes which are mounted at opposite ends of the half-axle and which are fixed to the half-axle at positions corresponding to each track gauge and means for translating and locking said running gear sets in positions corresponding to said different track gauges, said carrying frame incorporating the axle boxes of each running gear set and the means for translating and locking the said sets;

suspension springs incorporated in housings in front portions of the carrying frame and provided with vertical dampers mounted inside said suspension springs;

sliding shoes incorporated in lateral portions of the carrying frame to support the running gear during a change in track gauge;

suspension headers against which upper parts of the suspension springs bear, and in which bells of the vertical dampers are fixed;

arms for stabilizing the suspension headers;

hanging suspension links connected at upper ends thereof to the suspension headers and at lower ends thereof to a support integral with a frame of the wagon; and systems for guiding the running gear to cause an angle formed by a rim of each wheel and a tangent to a curve of the track to be zero at a point of contact of said rim with the track.

2. Apparatus according to claim 1, wherein each running gear set carries two locking keys, one for each axle box.

3. Apparatus according to claim 1, comprising a brake system for each running gear set including a pneumatic actuating cylinder and a caliper with friction linings which are applied by said cylinder against said brake discs.

4. Apparatus according to claim 3, wherein both the pneumatic actuating cylinder and the brake caliper with the friction linings are integral with a support which is fixed to an inner one of said axle boxes of the corresponding wheel and can be moved as a unit with the running gear set to adjust the brake system to both track gauges.

5. Apparatus according to claim 1, wherein one of said running gears is an intermediate running gear supporting adjacent trailers of the wagon, the guiding system of said intermediate running gear comprising two guidance lever arms fitted in a horizontal position in the carrying frame and two pairs of guide bars which are fixed at one of the ends thereof to respective adjacent end faces of the two trailers of the wagon.

6. Apparatus according to claim 1, wherein two of said running gears are end running gears, the guiding system comprising a control mechanism and a guidance mechanism including lever arms and two pairs of bars which are connected at one of the ends thereof to the said lever arms, the other of the ends of a first pair of bars being connected to bell cranks which form part of a compensation mechanism, and the other of the ends of the second pair of bars being connected to the wagon, while the control mechanism comprises two control bars having first ends connected to an end face of an adjacent trailer and second ends articulated to corresponding lever arms, adjustable bars being fitted between the said lever arms and the bell cranks of the compensation mechanism, and longitudinal arms of the said bell cranks being connected together by a crossbar which also forms part of the said compensation mechanism.

7. Apparatus according to claim 2, comprising a brake system for each running gear set including a pneumatic actuating cylinder and a caliper with friction linings which are applied by said cylinder against said brake discs.

8. Apparatus according to claim 7, wherein both the pneumatic actuating cylinder and the brake caliper with the friction linings are integral with a support which is fixed to an inner one of said axle boxes of the corresponding wheel and can be moved as a unit with the running gear set to adjust the brake system to both track gauges.

9. Apparatus according to claim 2, wherein one of said running gears is an intermediate running gear supporting adjacent trailers of the wagon, the guiding system of said intermediate running gear comprising two guidance lever arms fitted in a horizontal position in the carrying frame and two pairs of guide bars which are fixed at one of the ends thereof to respective adjacent end faces of the two trailers of the wagon.

10. Apparatus according to claim 3, wherein one of said running gears is an intermediate running gear supporting adjacent trailers of the wagon, the guiding system of said intermediate running gear comprising two guidance lever arms fitted in a horizontal position in the carrying frame and two pairs of guide bars which are fixed at one of the ends thereof to respective adjacent end faces of the two trailers of the wagon.

11. Apparatus according to claim 4, wherein one of said running gears is an intermediate running gear supporting adjacent trailers of the wagon, the guiding system of said intermediate running gear comprising two guidance lever arms fitted in a horizontal position in the carrying frame and two pairs of guide bars which are fixed at one of the ends thereof to respective adjacent end faces of the two trailers of the wagon.

12. Apparatus according to claim 7, wherein one of said running gears is an intermediate running gear supporting adjacent trailers of the wagon, the guiding system of said intermediate running gear comprising two guidance lever arms fitted in a horizontal position in the carrying frame and two pairs of guide bars which are fixed at one of the ends thereof to respective adjacent end faces of the two trailers of the wagon.

13. Apparatus according to claim 8, wherein one of said running gears is an intermediate running gear supporting adjacent trailers of the wagon, the guiding system of said intermediate running gear comprising two guidance lever arms fitted in a horizontal position in the carrying frame and two pairs of guide bars which are fixed at one of the ends thereof to respective adjacent end faces of the two trailers of the wagon.

14. Apparatus according to claim 2, wherein two of said running gears are end running gears, the guiding system comprising a control mechanism and a guidance mechanism including lever arms and two pairs of bars which are connected at one of the ends thereof to the said lever arms, the other of the ends of a first pair of bars being connected to bell cranks which form part of a compensation mechanism, and the other of the ends of the second pair of bars being connected to the wagon, while the control mechanism comprises two control bars having first ends connected to an end face of an adjacent trailer and second ends articulated to corresponding lever arms, adjustable bars being fitted between the said lever arms and the bell cranks of the compensation mechanism, and longitudinal arms of the said bell cranks being connected together by a crossbar which also forms part of the said compensation mechanism.

15. Apparatus according to claim 3, wherein two of said running gears are end running gears, the guiding system comprising a control mechanism and a guidance mechanism including lever arms and two pairs of bars which are connected at one of the ends thereof to the said lever arms, the other of the ends of a first pair of bars being connected to bell cranks which form part of a compensation mechanism, and the other of the ends of the second pair of bars being connected to the wagon, while the control mechanism comprises two control bars having first ends connected to an end face of an adjacent trailer and second ends articulated to corresponding lever arms, adjustable bars being fitted between the said lever arms and the bell cranks of the compensation mechanism, and longitudinal arms of the said bell cranks being connected together by a crossbar which also forms part of the said compensation mechanism.

16. Apparatus according to claim 3, wherein two of said running gears are end running gears, the guiding system comprising a control mechanism and a guidance mechanism including lever arms and two pairs of bars which are connected at one of the ends thereof to the said lever arms, the other of the ends of a first pair of bars being connected to bell cranks which form part of a compensation mechanism, and the other of the ends of the second pair of bars being connected to the wagon, while the control mechanism comprises two control bars having first ends connected to an end face of an adjacent trailer and second ends articulated to corresponding lever arms, adjustable bars being fitted between the said lever arms and the bell cranks of the compensation mechanism, and longitudinal arms of the said bell cranks being connected together by a crossbar which also forms part of the said compensation mechanism.

17. Apparatus according to claim 4, wherein two of said running gears are end running gears, the guiding system comprising a control mechanism and a guidance mechanism including lever arms and two pairs of bars which are connected at one of the ends thereof to the said lever arms, the other of the ends of a first pair of bars being connected to bell cranks which form part of a compensation mechanism, and the other of the ends of the second pair of bars being connected to the wagon, while the control mechanism comprises two control bars having first ends connected to an end face of an adjacent trailer and second ends articulated to corresponding lever arms, adjustable bars being fitted between the said lever arms and the bell cranks of the compensation mechanism, and longitudinal arms of the said bell cranks being connected together by a crossbar which also forms part of the said compensation mechanism.

18. Apparatus according to claim 8, wherein two of said running gears are end running gears, the guiding system comprising a control mechanism and a guidance mechanism including lever arms and two pairs of bars which are connected at one of the ends thereof to the said lever arms, the other of the ends of a first pair of bars being connected to bell cranks which form part of a compensation mechanism, and the other of the ends of the second pair of bars being connected to the wagon, while the control mechanism comprises two control bars having first ends connected to an end face of an adjacent trailer and second ends articulated to corresponding lever arms, adjustable bars being fitted between the said lever arms and the bell cranks of the compensation mechanism, and longitudinal arms of the said bell cranks being connected together by a crossbar which also forms part of the said compensation mechanism.

* * * * *